United States Patent [19]

Ross

[11] Patent Number: 4,787,639

[45] Date of Patent: Nov. 29, 1988

[54] GAME OF CHANCE

[76] Inventor: Robert J. Ross, 485 Coates Ave., Holbrook, N.Y. 11741

[21] Appl. No.: 36,362

[22] Filed: Apr. 8, 1987

[51] Int. Cl.[4] ..... A63F 3/00

[52] U.S. Cl. ..... 273/249; 273/254

[58] Field of Search ..... 273/242, 243, 248, 249, 273/251, 252, 254, 256, 258, 288, 289, 290

[56] References Cited

U.S. PATENT DOCUMENTS 3,582,080 6/1971 Schick ..... 273/290 X

FOREIGN PATENT DOCUMENTS 2223956 10/1974 France ..... 273/290
1120642 7/1968 United Kingdom ..... 273/256
1129581 10/1968 United Kingdom ..... 273/249
1187977 4/1970 United Kingdom ..... 273/256

*Primary Examiner*—Richard C. Pinkham
*Assistant Examiner*—William E. Stoll
*Attorney, Agent, or Firm*—Richard L. Miller

[57] ABSTRACT

This game is designed for entertainment fun and consists of a game board, a multiple number of playing pieces shaped like musicians and their instruments, a multiple number of discs that receive flags with music note symbols, tokens, cards, and a die. The game board consists of two separate paths, one representing the life of a rock musician and the other representing the position of a record on the charts. The winner of the game is the first player to advance their disc to the number 1 space. The disc may be advanced by completing a circuit of the outer path with the token or by collecting a specified number of flags which are placed in the disk.

1 Claim, 1 Drawing Sheet

GAME OF CHANCE

BACKGROUND OF THE INVENTION

The instant invention relates generally to competitive game, and more specifically to a game of chance.

Numerous games of chance have been provided in the prior art that are adapted to being played for amusement an relaxation. For example, U.S. Pat. Nos. 3,572,718 to J Moore; 4,052,071 to Siegfried; and 4,283,059 to Beeder; all are illustrative of such prior art. While these units may be suitable for the particular purpose to which they address, they would not be as suitable for the purpose of the present invention as hereafter described.

SUMMARY OF THE INVENTION

A primary object of the present invention is to provide a game of chance that will overcome the shortcomings of the prior art devices.

Another object is to provide a game of chance.

An additional object is to provide a game of chance, which will be unique, in that it will be involved with rock music.

A further object is to provide a game of chance that is simple and easy to use.

A still further object is to provide a game of chance that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
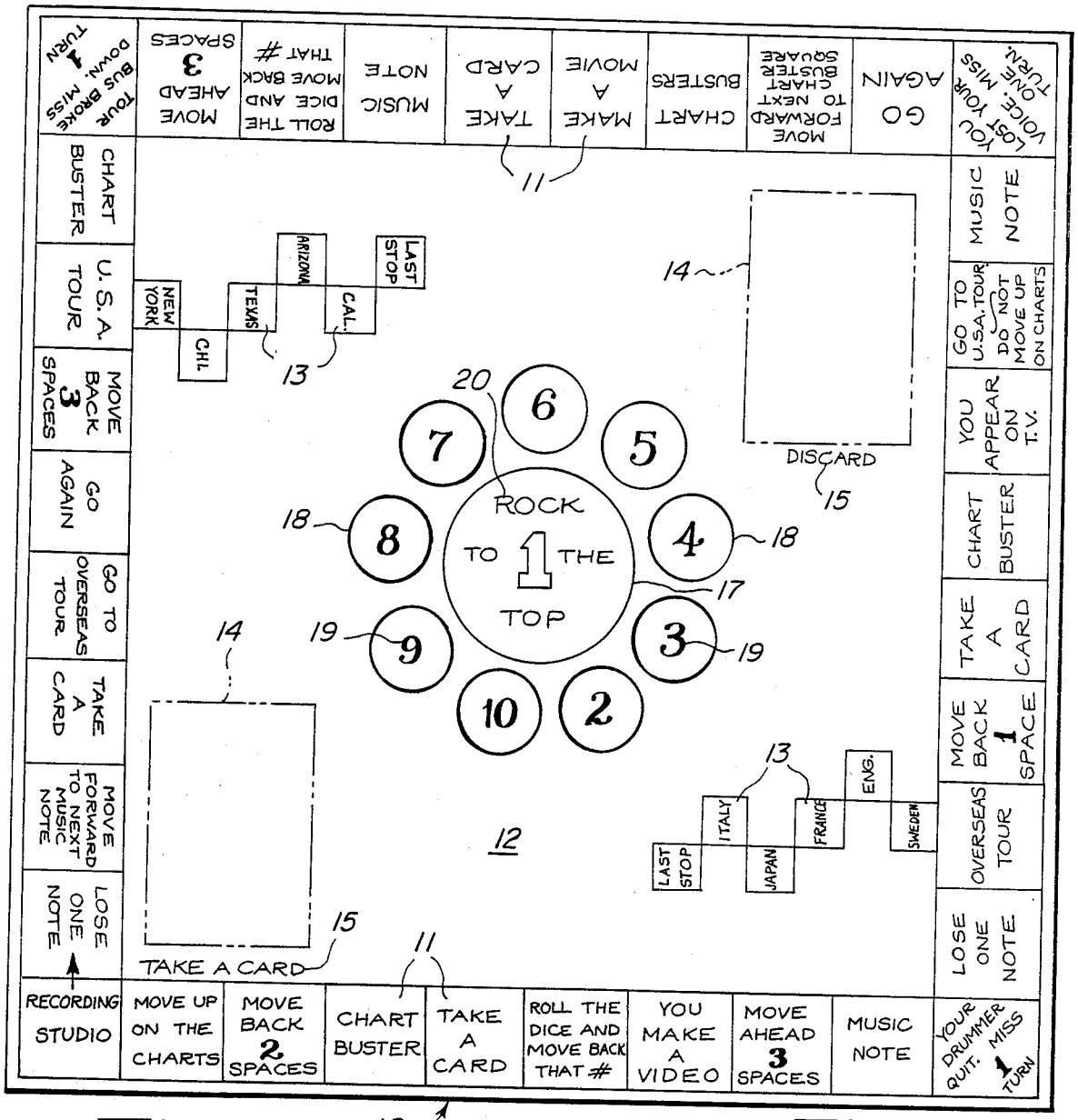
FIG. 1 is a top plan view of a game board of the present invention.
Figure 2:
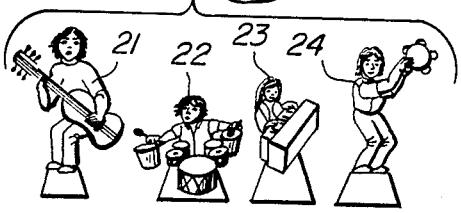
FIG. 2 is a front view of the playing pieces of the game shown in elevation and comprising a guitarist, drummer, and a tambotino player.
Figure 4:
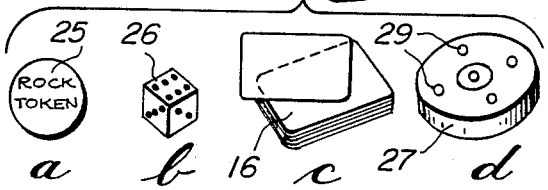
FIG. 4 is a perspective view of other items employed in playing the game.
Figure 3:
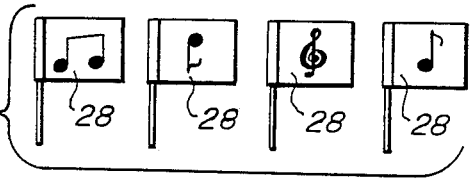
FIG. 3 is a side view of music note flags, shown in elevation and are employed in the playing of the game.

Turning now descriptively to the drawings, in which like reference characters denote like elements throughout the several views, FIG. 1 illustrates a game board 10, which in this instance is square in configuration and is provided with a plurality of adjacent squares 11 imprinted in the border area. Other squares 13 are also imprinted on face 12, and one of corner adjacent squares 13 of two space rows, abuts with the squares 11 of the border area, and all of the squares 11 and 13 are imprinted with letter and numerical characters indicating play of the game. Rectangular boxes 14 are also imprinted on face 12, one of the pair being disposed in diagonal relationship with the other in corners defined by the squares 11. One of the boxes 14 is identified by letter characters 15 and the other box is similarly identified by 15, and are designed as placement means for taking a card and discarding a card from a deck of cards 16. A large diameter circle 17 is centrally disposed on face 12 and a plurality of smaller circles 18 are radially and equally spaced around circle 17, and each include a numerical character 19 imprinted thereon. The circle 17 is further imprinted with letters characters 20 indicating the name of game 10, which is "ROCK TO THE TOP". Playing pieces 21, 22, 23 and 24, are also provided for playing game. Token 25, die 26 and phonograph record rock chart pieces 27, along with flags 28, are also employed in playing game. The flags 28 imprinted with musical notes, are received in the vertical openings 29 provided in the face of discs 27.

It shall be noted, that the object is to be the first player to move a playing piece 21, 22, 23, or 24 to the center or the number one position as indicated in the circle 17 on the face 12 of the game board 10. One deck of forty four cards 16, one die 26, sixteen music note flags 28, twelve rock tokens 25 four rock chart pieces 27, and four rock star playing pieces that are indicated as 21, 22, 23, and 24, are used.

HOW TO SET UP THE GAME (1) Open the game board 10, and place it on a flat surface. Be sure everyone has a good view.

(2) Each player chooses one Rock Star playing piece, 21–24 and a rock chart piece 27 of matching color. The chosen Rock chart piece 27 is placed on number "10" on the rock charts circle 18.

(3) Shuffle the cards 16 and place them face down on the square 14 marked "Take a card".

HOW TO PLAY THE GAME (1) Each player rolls the die 26. The player rolling the highest number goes first. The other players to the left then go next.

(2) How to move: All pieces move clockwise. Roll the die 26 and do the following:

(A) Move your rock star playing piece the number of squares shown on the die 26. Then follow the directions of the square that you land on.

(B) When your rock star playing piece has made it around the board 10, you move your rock chart piece up one number on the rock charts. Note: The rock at number "10", and moves up the charts next to number "9", then "8","7","6","5","4","3","2" and when you reach number "1" you win the game. Note: When a player passes the move up on the charts square, (unless a card or a square has told you not to) you must move your rock chart piece 27 up one number on the charts before you continue your turn.

(3) If you land on a music Note square 11, you receive one music note flag 28. There are four holes 29 in the rock chart piece 27. Place the music note flag 28 in one of the holes.

(A) If you land on one of the following squares:

1. You make a video,
2. Make a movie,
3. You appear on T.V.

You are given a Rock Token 25. When you have collected three rock tokens you can trade then in for one music note flag 28.

(B) Upon receiving a fifth music note flag 28, your Rock Chart piece 27 moves up two numbers on the charts. Then remove the four music note flags 28, and you can start collecting then again.

(4) If a player is on the recording studio square, or is forward of it, and he is instructed to and then moves backwards and he lands on move up on the charts, he moves up one number on the rock charts. If he moves backwards and passes or lands on move up on the charts, he moves up one number on the charts.

(5) Cards: Cards are shuffled and placed on the spot marked cards. When you land on a take a card square, take a card and follow the instructions, then place the card face down on the spot marked discards. When all cards have been used, shuffled them and use then again.

(6) Special Cards:

(A) Rock Bonus Card: Save this card for anytime you are;

1. Supposed to miss a turn, or
2. When you land on or are sent to U.S.A. Tour, or Overseas Tour. Play the card and you will;
1. Not miss a turn, or
2. You will not have to enter the U.S.A. Tour squares, New York, Chicago, etc., or the Overseas Tour squares, Sweden, England, etc. When you play this card it is then placed on the discard spot.

(B) Move forward to the next Chart Buster Square: After going to the chart buster square, roll the die, if a six is rolled you move up one number on the rock charts. If a one is rolled, you move back one number on the rock charts.

(7) Chart Buster Square: If you land on this square, roll the die.

(A) If you roll a six, move up one number on the rock charts.

(B) If you roll a one, move back one number on the rock charts.

(8) Lose One Note Square: If you land on this square, you must give back one music note fag.

(9) Overseas Tour: If a player lands on this square, or is sent there, he must, on his next move, travel into the squares marked with the countries. You must reach the last stop on the exact number. Then you must move back down the countries. You can only exit from the overseas tour on an even number. Note: A Rock Bonus card can be played, if you have one, to save you from going on an overseas tour.

(10) U.S.A. Tour: If a player lands on this square, or is sent there he must, on his next move, travel into the squares marked with start. He must reach the last stop on the exact number. Then you must move back down the states. You can only exit from the U.S.A. Tour on a even number.

Note: A Rock Bonus card can be played, if you have one, to save you from going on a U.S.A. tour.

(11) When you must go on a U.S.A. or Overseas Tour, and after you have landed on a State or a Country, you can call out the words "Rock it" this must be done on another's player turn, and before they roll the die. If the player rolls a six, you can move your rock star piece directly to the last stop on the tour. Note: The other player's rock star piece can not be on a U.S.A. or Overseas tour. That is the piece can not be on a state or a Country square.

Go to Overseas Tour. Do not pass move up on the charts, do not move up one number on the rock charts.

Go directly to U.S.A. Tour. Do not pass move up on the charts, do not move up one number on the rock charts.

Move forward to the next chart buster square, then roll the dice. If you roll a 6 move up one number on the Rock charts. If you roll a 1 move back one number on the rock charts. (There are three of these cards)

Your record is now at number 9 on the rock charts.

Your record is now at number 6 on the rock charts.

Your record is now at number 5 on the rock charts.

Your record slipped back 1 number on the rock charts.

Your record slipped back 2 numbers on the rock charts.

Go Again. (There are four these cards)

Move back one space.

Move back two spaces.

Move back four spaces. (There are three of these cards.)

Move ahead one space.

Move ahead two spaces.

Move ahead three spaces.

Roll the dice and move backward that number. (There are two of these cards.)

Move forward to the next music note square, and take one music note flag.

Rock Bonus Card. Save this card for anytime you are; (1) Supposed to miss a turn, or (2) When you land on or are sent to and you will; (1) Not miss a turn, or (2) You will not have to enter the U.S.A. Tour squares, These begin with New York. Or you will not have to enter the overseas tour squares, these begin with Sweden. After you play this card, place it on the discard spot. (There are two of these cards.)

The following is a list of the cards used in the game.:

You lost your voice. Go to that square and miss one turn. Do not pass move up on the charts. Do not move up one number on the rock charts.

It's selling like hot cakes. Go directly to move up on the charts, and move up one number on the rock charts.

Go to make a movie, and collect one rock token. If you pass move up on the charts, move up one number on the rock charts, move up one number on the rock charts. (there are two of these cards.)

Go to appear on T.V. and collect one rock token. If you pass move up on the charts, move up one number on the rock charts. (There are two of these cards.)

Go make a video, and collect one rock token. If you pass move up on the charts, move up one number on the rock charts. (There are two of these cards.)

Your tour bus broke down. Go to that square and miss one turn. Do not pass move up on the charts, do not move up one number on the rock charts.

Your Drummer quit. Go to that square and miss one turn. Do not pass move up on the charts, do not move up one-number on the rock charts.

Save this card to hire another drummer, so you do not miss a turn.

Save this card to repair your tour bus, so you do not miss a turn.

Save this card to get your voice back so you do not miss a turn.

Your U.S.A.Tour is a big success. Go directly to move up on the charts, and move up one number on the rock charts.

Your Overseas Tour is sold out. Go directly to move up on the charts, and move up one number on the rock charts.

Go directly to the recording studio, do not pass move up on the charts, do not move up one number on the rock charts.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A game of chance, comprising, a game board, a plurality of imprinted squares and circles imprinted on said board, with numerical and instructional indicia printed within to facilitate playing the game, and arranged so as to constitute a play path over which playing pieces can move, a plurality of playing pieces employed in playing said game of chance, and a plurality of circular discs provided for playing said game of chance, wherein each playing piece of said plurality of playing pieces is a figure of a musician and an instrument and each of said plurality of circular discs has two parallel surfaces and is provided with four radially and equally spaced holes perpendicular to said surfaces, wherein a plurality of flags with a musical note imprinted on faces of said flags, are removably received in the holes provided in said discs.

* * * * *